US005311754A

United States Patent [19]

Itgenshorst et al.

[11] Patent Number: 5,311,754

[45] Date of Patent: May 17, 1994

[54] STEAM-FILLED TREATMENT CHAMBER

[75] Inventors: Dietrich Itgenshorst; Walter Otten, both of Krefeld, Fed. Rep. of Germany

[73] Assignee: Eduard Küsters Maschinenfabrik GmbH & Co. KG, Krefeld, Fed. Rep. of Germany

[21] Appl. No.: 983,582

[22] PCT Filed: Jul. 12, 1991

[86] PCT No.: PCT/DE91/00574

§ 371 Date: Feb. 4, 1993

§ 102(e) Date: Feb. 4, 1993

[87] PCT Pub. No.: WO92/02675

PCT Pub. Date: Feb. 20, 1992

[30] Foreign Application Priority Data

Aug. 7, 1990 [DE] Fed. Rep. of Germany ..... 4025010

[51] Int. Cl.[5] ..... D06B 3/12

[52] U.S. Cl. ..... 68/5 D

[58] Field of Search ..... 68/5 C, 5 D, 5 E, 212; 34/159, 243 R; 432/247; 220/608, 669

[56] References Cited

U.S. PATENT DOCUMENTS

| | | | |
|---|---|---|---|
| 2,777,750 | 1/1957 | Sprague et al. | 68/5 D |
| 3,074,261 | 1/1963 | Wilcox | 68/5 D |
| 3,166,923 | 1/1965 | Zacks | 68/5 C |
| 3,477,073 | 11/1969 | Blount et al. | 8/149.1 |
| 4,873,846 | 10/1989 | Talbert, Jr. | 68/5 |

FOREIGN PATENT DOCUMENTS

| | | |
|---|---|---|
| 0175018 | 3/1986 | European Pat. Off. . |
| 2033527 | 3/1977 | Fed. Rep. of Germany . |
| 1149340 | 4/1969 | United Kingdom . |
| 2043127 | 10/1980 | United Kingdom . |

*Primary Examiner*—Philip R. Coe

*Attorney, Agent, or Firm*—Kenyon & Kenyon

[57] ABSTRACT

The inner wall of the ceiling of a steam-filled treatment chamber is made of plastic and has a relief structure with peaks that face the treatment chamber. The spacing between the peaks is smaller than the normal drop diameter, i.e., is smaller than 1 mm. On the side of the inner wall of the ceiling facing away from the treatment chamber, an air gap is provided and maintained by distance pieces. A heat-insulation layer is arranged outside of the air gap.

26 Claims, 1 Drawing Sheet

STEAM-FILLED TREATMENT CHAMBER

BACKGROUND OF THE INVENTION

The invention relates to a steam-filled treatment chamber.

For quite some time, one has known of the problem posed by falling drops, that condense out of the steam atmosphere on the ceiling of a steam-filled treatment chamber. This problem occurs when solid-shade dyed textile webs are treated in a steam-filled treatment chamber. When a water droplet falls onto a web which has not yet undergone full fixation, the result is an excess of water at this spot, i.e., a variation in concentration. This causes the dye in the web to migrate into the more strongly diluted area. This migration is manifested in a variation in the depth of the color shade, i.e., in a spot which is clearly visible on the finished fabric and which makes this fabric unusable, or in any case causes it to deteriorate in quality. It is, therefore, customary to provide means to prevent the drops from falling.

The EP-A1 175 018 discloses a steam-filled treatment chamber of this type, in which the inner wall of the ceiling is made of metal, such as stainless steel or light metal. The means for preventing drops from falling from the ceiling consist of a heating system which employs heating tubes that are arranged outside of the inner wall. These heating tubes are charged, for example, with steam, hot air, or oil. The heating tubes are distributed in a gap situated between the inner walls and an outer insulation layer. The inner wall, which is made of sheet metal and which borders the treatment chamber is smooth. The heating system keeps the inner wall at the correct temperature, so that no liquid can condense from the steam and no drops will form. However, this entails a design of considerable complexity, because heating tubes are placed over the entire surface of the inner wall.

It is also known to prevent drops from forming without covering the ceiling area of the steam-filled treatment chamber with heating tubes, by providing saw tooth-shaped formations in a cross-section on the ceiling. The condensing liquid flows along the edges of the saw teeth down to their bottom peaks. In this case, additional measures must be provided to prevent dripping, whether in the form of collecting grooves or in the form of heating tubes that run along the peak as disclosed by the German Patent 20 33 527. Here, as well, the complexity of design required to prevent drops from forming is considerable; because of the saw-tooth-shaped formation of the ceiling of the treatment chamber, as well as the additional means required the bottom peaks of the saw teeth.

The object of the present invention is to develop a treatment chamber that prevents the formation of condensation drops which adversely affect the quality of the material being treated, without requiring an additional heating system and by using relatively simple means as described by the present invention.

SUMMARY OF THE INVENTION

The steam-filled treatment chamber of the present invention has means for preventing condensation drops from falling from the ceiling, wherein the means is a relief structure on the surface of the ceiling facing the treatment chamber. The relief structure has subdivisions that form peaks that face the treatment chamber, and the spacing between the peaks is smaller than the normal drop diameter.

The subdivision of the relief structure is characterized by the spacing between the elevation that form peaks. This spacing should be small compared to the size of the drops to be expected when the bottom side of the treatment chamber ceiling has a smooth formation. The diameter of these drops range from about 2 to 4 mm. The purpose of the relief structure is to prevent large condensation drops from forming and to cause the drops that do form to be removed before reaching a harmful size, which is the size at which the drops would be noticeable in the material to be treated. This present invention differs from the known specific embodiment of a saw-tooth-shaped formation of the ceiling, in that the spacing from "peak to peak", i.e., from one saw-tooth apex to the next, is about ten centimeters while the "peak to peak" spacing of the relief structure of the present invention is smaller than 4 mm. Preferably the spacing between the elevations of the relief described in the present invention is smaller than 1 mm.

When the relief has a uniform grid formation, a uniform effect is achieved over the surface and manufacturing by stamping or similar methods is facilitated.

The function of the relief structure is bolstered considerably when the individual elevations of the relief form tips. In particular the elevations may be conical or pyramid shape wherein the tips hold the forming water droplets very poorly, so that they fall off before reaching a harmful size.

To avoid heat losses that promote condensation, the inner wall that constitutes the ceiling should be made of a material with poor thermal conductivity such as plastic. Insulation is further improved by an air gap that is maintained between the ceiling and the heat insulation layer. Such an air gap is also provided, by the EP-A1 175 018, but in the present invention, the air gap is maintained by special distance pieces rather than by heating tubes.

BRIEF DESCRIPTION OF THE DRAWINGS

Exemplified embodiments of the invention are schematically depicted in the drawing.

DETAILED DESCRIPTION

Figure 1:
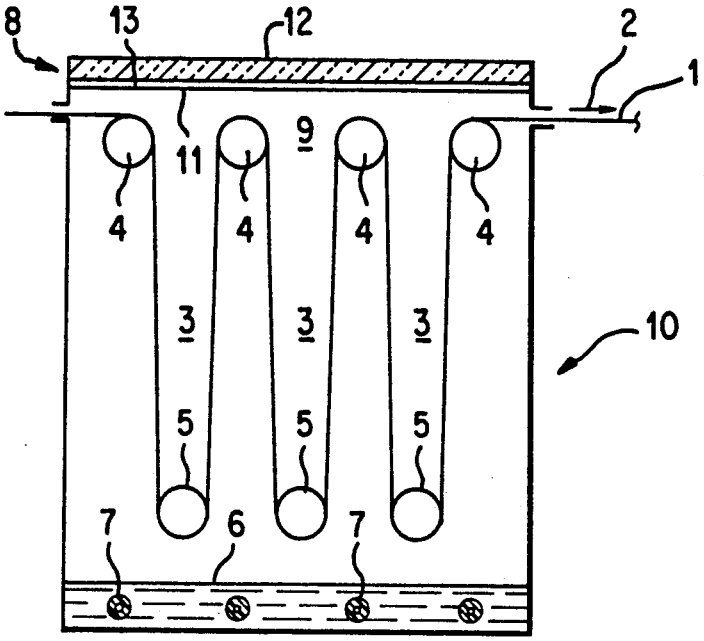
FIG. 1 shows a section through a steam-filled treatment chamber equipped with a ceiling in accordance with the invention.

The steam-filled treatment chamber denoted 10 in FIG. 1 is used for the steaming treatment of a textile web 1, which is guided in the direction of the arrow 2 in vertical loops 3 through the steam-filled treatment chamber. The steam-filled treatment chamber. The ager is comprised of an upper row of guide rolls 4 arranged in a horizontal plane 2 and of a lower row of guide rolls 5 arranged in a second horizontal plane. The steamed-filled treatment chamber 10 is a rectangular box and, at the bottom, has a water sump 6, which is heated by radiators 7 to produce the steam atmosphere. The ceiling 8 consists of an inner wall 11 facing the treatment chamber 9, a heat-insulation layer 12 that is arranged on the outside of inner wall 11, and an air gap 13 that is maintained between them.

Figure 2:
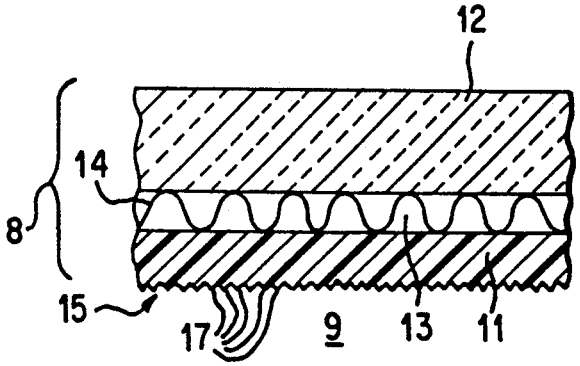
FIG. 2 depicts a cut-away portion of the ceiling area of FIG. 1.

As is apparent from FIG. 2, the air gap 13 is maintained by distance pieces 14, which are arranged between the inner wall 11 and the heat-insulation layer 12 and consist of a wire grating or of suitably formed plastic structures.

The inner wall 11 is formed to prevent large drops from forming. It consists of an essentially flat plastic board, about 5 to 10 mm thick, which has a relief structure 15 on the side facing the treatment chamber 9. This relief structure 15 will be clarified in detail on the basis of FIG. 3 to 6.

The relief structure 15 consists of small elevations, which are distributed closely together over the surface of the inner wall 11 and protrude downward from the imaginary flat bottom of inner wall 11.

Figure 3:
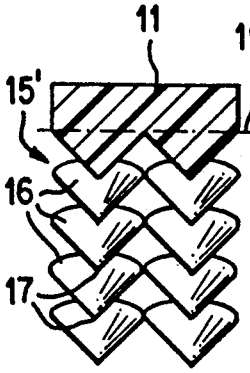
FIG. 3 illustrates a perspective partial view from below of the relief structure according to FIG. 2.
Figure 4:
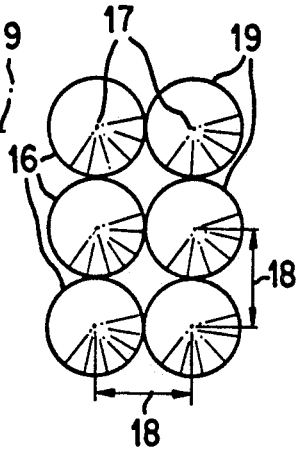
FIG. 4 shows a cross section of the relief structure according to FIG. 3.

The relief structure 15' shown in FIG. 3 and 4 is made up of cones 16, that are arranged in a rectangular grid. The cones 16 face the treatment chamber 9 with their tips 17 and rise up out of the bottom side 19 of the inner wall. The circular, imaginary bases of the cones 16 lying in the plane of the bottom side 19 of the inner wall 11 are situated in the flat bottom side 19 and adjoin one another in the manner as is apparent from FIG. 4. In the exemplified embodiment, the apex angle at the tips of cones 16 is 90°.

Figure 5:
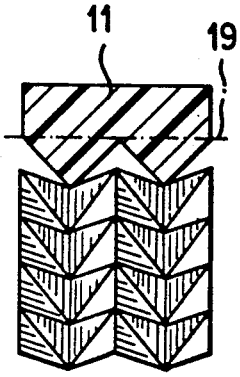
FIG. 5 depicts a perspective partial view from below of a second embodiment of the present invention.
Figure 6:
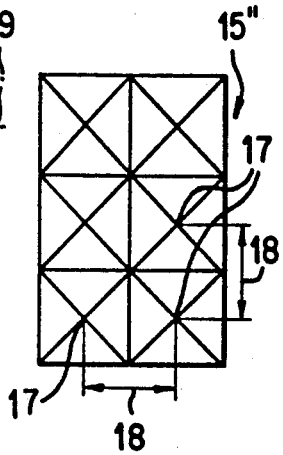
FIG. 6 depicts a cross section of the relief structure to FIG. 5.

In the case of the relief structure 15" shown in FIG. 5 and 6, the elevations consist of four-sided pyramids having square bases. They rise up out of the bottom side 19 of the inner wall 11, and adjoin one another with their bases situated in this bottom side 19. The angle measured between two mutually opposing sides of the pyramids is 90°.

In both embodiments the angles can be smaller, making the cones or pyramids more pointed.

It is important for the subdivision of the relief structures 15,15',15" to be smaller than the diameter of water droplets which form on a smooth surface, i.e., smaller than, for instance, 2 to 4 mm. In the embodiments illustrated in FIG. 4 and FIG. 6, the subdivision of the relief, that is the spacing 18 from tip 17 to tip 17, is about 0.8 mm. Because the grid is square in both embodiments 15' and 15", these spacings are the same in both directions.

The material of the inner wall 11 can be a thermoplastic plastic, wherein the relief structure 15 is stamped. Plastic has a low thermal conductivity, that counteracts the occurrence of cold spots.

What is claimed is:

1. A steam-filled treatment chamber for material that is sensitive to condensation drops, comprising:

an inner wall of the treatment chamber that forms the ceiling of the treatment chamber, a heat-insulation layer that surrounds the inner wall, and means for preventing drops that are large enough to harm the material being treated from falling from the ceiling, wherein said means comprise a relief structure on the surface of the ceiling facing the treatment chamber, said relief structure having subdivisions, the spacing between said subdivisions being smaller than the diameter of the drop.

2. The treatment chamber according to claim 1, wherein the spacing between the elevations of the relief structure is smaller than 1 mm.

3. The treatment chamber according to claim 2, wherein the relief structure is formed in a uniform, two-dimensional grid.

4. The treatment chamber according to claim 2, wherein the subdivisions are elevations of the relief structure that form peaks.

5. The treatment chamber according to claim 2, wherein the inner wall of the ceiling of the treatment chamber is made of a material having poor thermal conductivity.

6. The treatment chamber according to claim 2, further comprising distance pieces provided between the inner wall of the ceiling and the heat-insulation layer to maintain an air gap.

7. The treatment chamber according to claim 1, wherein the relief structure is formed in a uniform, two-dimensional grid.

8. The treatment chamber according to claim 7, wherein the subdivisions are elevational of the relief structure that form peaks.

9. The treatment chamber according to claim 7, wherein the inner wall of the ceiling of the treatment chamber is made of a material having poor thermal conductivity.

10. The treatment chamber according to claim 7, further comprising distance pieces provided between the inner wall of the ceiling and the heat-insulation layer to maintain an air gap.

11. The treatment chamber according to claim 1, wherein the subdivisions are elevations of the relief structure that form peaks.

12. The treatment chamber according to claim 11, wherein the elevations of the relief structure have a conical or pyramid shape.

13. The treatment chamber according to claim 12, wherein the inner wall of the ceiling of the treatment chamber is made of a material having poor thermal conductivity.

14. The treatment chamber according to claim 12, further comprising distance pieces provided between the inner wall of the ceiling and the heat-insulation layer to maintain an air gap.

15. The treatment chamber according to claim 11, wherein the inner wall of the ceiling of the treatment chamber is made of a material having poor thermal conductivity.

16. The treatment chamber according to claim 11, further comprising distance pieces provided between the inner wall of the ceiling and the heat-insulation layer to maintain an air gap.

17. The treatment chamber according to claim 1, wherein the inner wall of the ceiling of the treatment chamber is made of a material having poor thermal conductivity.

18. The treatment chamber according to claim 17, wherein the inner wall constituting the relief structure is made of plastic.

19. The treatment chamber according to claim 17, further comprising distance pieces provided between the inner wall of the ceiling and the heat-insulation layer to maintain an air gap.

20. The treatment chamber according to claim 1, further comprising distance pieces provided between the inner wall of the ceiling and the heat-insulation layer to maintain an air gap.

21. The treatment chamber according to claim 1, wherein steam-filled treatment chamber is configured for use with a material that is a textile web.

22. The treatment chamber according to claim 21, wherein the relief structure is formed in a uniform, two-dimensional grid.

23. The treatment chamber according to claim 22, wherein the subdivisions are elevations of the relief structure that form peaks.

24. The treatment chamber according to claim 23, wherein the elevations of the relief structure have a conical or pyramid shape.

25. The treatment chamber according to claim 21, further comprising distance pieces provided between the inner wall of the ceiling and the heat-insulation layer to maintain an air gap.

26. The treatment chamber according to claim 21, wherein the spacing between the elevations of the relief structure is smaller than 1 mm.

* * * * *

UNITED STATES PATENT AND TRADEMARK OFFICE

CERTIFICATE OF CORRECTION

PATENT NO. : 5,311,754
DATED : May 17, 1994
INVENTOR(S) : Itgenshorst et al.

It is certified that error appears in the above-indentified patent and that said Letters Patent is hereby corrected as shown below:

In column 1, line 53, change "required" to -- required on --;

Column 2, line 4, change "elevation" to -- elevations --;

Column 2, line 63, delete ". The ager";

Column 3, line 25, change "wall" to -- wall 11. --;

Column 4, line 19, change "elevational" to -- elevations --.

Signed and Sealed this

Seventh Day of March, 1995

*Attest:*

Bruce Lehman

BRUCE LEHMAN

*Attesting Officer*

*Commissioner of Patents and Trademarks*